US005509534A

United States Patent [19]

Taravella et al.

[11] Patent Number: 5,509,534

[45] Date of Patent: Apr. 23, 1996

[54] TWO-PIECE DUNNAGE FOR USE IN A CONTAINER

[75] Inventors: Philip Taravella, Grosse Pointe Shores; Ronald S. Domanski, St. Clair Shores; Kevin Burchett, Sterling Heights; Edward J. Blair; Joseph G. Shippell, both of New Baltimore, all of Mich.

[73] Assignee: Anchor Bay Packaging Corporation, St. Clair Shores, Mich.

[21] Appl. No.: 313,413

[22] Filed: Sep. 27, 1994

[51] Int. Cl.[6] ..... B65D 81/02; B65D 85/30

[52] U.S. Cl. ..... 206/587; 206/449; 206/454; 206/453; 206/586

[58] Field of Search ..... 206/449, 454, 206/453, 456, 334, 586, 587, 521

[56] References Cited

U.S. PATENT DOCUMENTS

| | | | |
|---|---|---|---|
| 2,256,995 | 9/1941 | Andres | 206/586 |
| 2,337,468 | 12/1943 | Hilger | 206/454 |
| 3,362,609 | 1/1968 | Freedy | 206/454 |
| 3,559,866 | 2/1971 | Olson | 206/454 |
| 4,182,450 | 1/1980 | Kryger | 206/586 |
| 4,317,517 | 3/1982 | Tisdale | 206/586 |
| 4,763,782 | 8/1988 | Sinchok | 206/334 |
| 5,105,970 | 4/1992 | Malone et al. | 206/523 |

*Primary Examiner*—Paul T. Sewell
*Assistant Examiner*—Marie Denise Patterson

[57] ABSTRACT

A two-piece plastic dunnage is disclosed for use within containers for shipping or storing items in a preselected arrangement within a container. The preferred embodiment of the two-piece dunnage designed in accordance with this invention includes an essentially flat base member and a generally U-shaped support member that is slidably and removably coupled with the base member in a supporting position. The support member may be provided with a plurality of transverse slots which are adapted to nestingly receive at least a portion of the items that are to be maintained within the container in the preselected arrangement.

7 Claims, 2 Drawing Sheets

TWO-PIECE DUNNAGE FOR USE IN A CONTAINER

BACKGROUND OF THE INVENTION

1. Field of the Invention

This invention relates generally to dunnages for use in maintaining, cushioning, storing and/or shipping items within a container such as a box, carton, rack, pallet or other carrying device. More particularly, this invention relates to a two-piece dunnage formed from a resilient plastic material including a support member that is coupled with a base member for maintaining at least one item in a preselected arrangement within the container.

2. Description of the Prior Art

A variety of packaging materials and dunnages are used in order to maintain items within boxes, containers or other carrying devices in a desired fashion for shipping or storage purposes. For example, historically dunnages have been used to maintain items within a box upward and away from the bottom wall of the box. Such applications prove useful, for example, for keeping the item safe from undesirable contact with sharp items or to avoid possible water damage in the event the bottom wall of the box becomes wet. Dunnages are also used to keep a plurality of items in a preselected, orderly arrangement within a box or container during shipment or storage.

A variety of materials have been historically used for dunnages, including wood, Styrofoam and plastic. Recent developments in the use of plastic dunnages include using tubular members to form a dunnage. Although the tubular plastic dunnages provide advantages over wooden dunnages, for example, the former include several drawbacks and shortcomings.

First, the tubular dunnages, once formed, are useful for only a single application or only with one type of product to be shipped or stored. This results from the nature of the tubular dunnage in that it has a specific shape, size and ability to support and receive only a specific type of product. Second, the tubular dunnages are limited in that they can typically only be applied in a box when the dunnages are laid flat along the bottom of the box or laid flat between layers of the products to be shipped.

Although the plastic tubular dunnages are recyclable (according to modern technology) the need to create new dunnages each time one is presented with a product differing in shape or size introduces unnecessary costs in time and materials to produce the appropriate dunnages for each situation.

Accordingly, it is desirable to provide a plastic dunnage that does not suffer from the drawbacks mentioned above. Further, it is desirable to provide a plastic dunnage that does not have the shortcomings associated with the tubular dunnages described above.

Accordingly, this invention provides a two-piece plastic dunnage that is useful for maintaining, cushioning, shipping and/or storing items within a container or other carrying device in a preselected arrangement. As will be more fully described below, the two-piece nature of the plastic dunnage provided by this invention provides greater flexibility and use and the ability to interchange parts within the dunnage such that at least one of the pieces of the dunnage is reusable in an essentially infinitely variable manner.

SUMMARY OF THE INVENTION

In its most general terms, this invention provides a container or carrying device for shipping, storing, maintaining or cushioning at least one item in a preselected arrangement within the container. As an example, a container may include a box that has four sidewalls and a bottom wall. The box is preferably adapted to completely receive the item that is to be shipped or stored. A dunnage, placed within the box, includes a base member having a first and second face, where the first face is adapted to be placed against one of the walls of the box including the side and bottom walls and the top wall, if any is provided in the box. A dunnage support member is removably coupled with the base member and has a raised portion that extends distally from the base member second face. The support member also includes a pair of flanges that extend transversely outward from opposite transverse ends on the raised portion. The flanges are directly adjacent the base member second face when the support member is coupled with the base. The raised portion of the support member if used for cushioning of items may not require any slots or slits. However, the raised portion when used to store or ship certain items may include at least one transverse slit that is adapted to nestingly receive at least a portion of the item to be shipped or stored such that the item is maintained within the box in the preselected arrangement.

The base member is essentially flat and, if required may be attached to a wall of the box by staples, rivets, sonic welding, adhesive or other fastening means. In one embodiment of this invention, the base member includes an adhesive on the first face such that the base member can be glued or adhesively secured to the bottom, top or side walls of a box. The most preferred embodiment of this invention includes the dunnage support member raised portion being generally parabolic or U-shaped. It may have one or a plurality of transverse slits through the U-shaped raised portion such that a plurality of items can be shipped or stored within a box in an orderly preselected arrangement.

This invention also provides a method for forming a two-piece dunnage to be used within a container for shipping or storing at least one item in a preselected arrangement within the container. The method of forming the two piece dunnage has three basic steps: first, providing a base member that is adapted to be placed within the container; second, forming a support member out of an essentially flat resilient piece of plastic material; and third, coupling the base member with the support member such that the support member is capable of cushioning the item or supportingly receiving the item and maintain in the item within the preselected arrangement within the container for shipping or storage purposes. The support member is formed by the following certain substeps. First, an essentially flat piece of flexible plastic material is provided and is preferably longer than it is wide and wider than it is thick. Second, in certain applications, at least one transverse slit is cut in the essentially flat piece of plastic. Third, the essentially flat piece of plastic is perforated along two essentially parallel lines along a longitudinal length of the flat piece of plastic. Fourth, the cut and perforated piece of plastic (with or without slits) is shaped such that a curved portion or raised portion is defined between the perforations that are formed in the third substep above. Lastly, the piece of plastic is folded along the perforations that are formed in the third substep above such that a pair of flanges are defined, which extends transversely outward from the perforations to opposite transverse ends on the piece of plastic. Then the base member and support member are preferably slidingly coupled together by having the flanges of the support member being slidingly received within notches, slots or nesting portions defined on the base member.

These and other features and advantages associated with this invention will become apparent to one skilled in the art from the following detailed description of the preferred embodiments and the appended drawings.

DETAILED DESCRIPTION OF THE PREFERRED EMBODIMENTS

Figure 1:
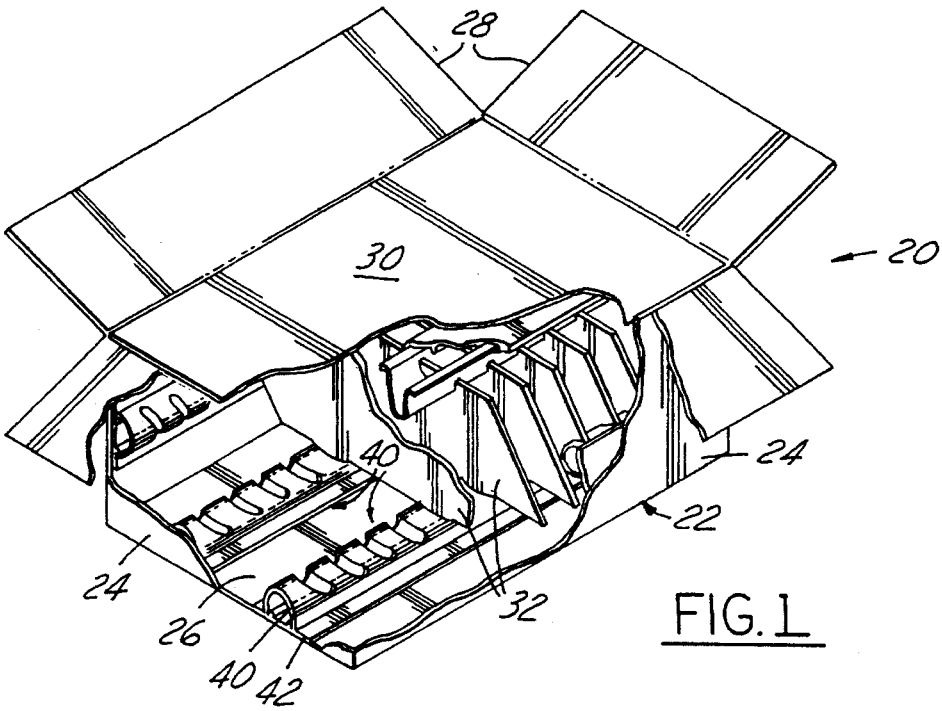
FIG. 1 is a partial cut-away illustration of a container embodying two-piece plastic dunnages for maintaining a plurality of items in a preselected arrangement within the container.

FIG. 1 illustrates a container or other carrying device 20 in the form of a box 22. Box 22 is a conventional corrugated box (or it could be made of other appropriate materials) including a body having sidewalls 24, bottom wall 26, top flaps 28 and top wall 30. Items 32 are shown disposed within box 22 in a preselected orderly arrangement. Dunnages 40 are employed within box 22 in order to maintain items 32 in the preselected arrangement during shipping or storage of items Referring now to FIGS. 1 through 4, dunnages 40 are made up of a first elongated base member or base 42 and a second elongated and support member 44. Base 42 includes slots which are defined by flanges 48. Flanges 48 preferably consist of an upwardly extending portion or side wall 50 and a transversely extending portion or top wall 52 that begins at a most distal end of the upwardly extending portion 50 and extends transversely in a plane generally parallel to a plane defined by the top face or surface 54 of base 42. Face 54 of base 42 is referred to herein as the top face on top surface of the base 42. An essentially flat bottom face or surface 55 of base 42 is adapted to be placed against one of the walls of box 22 such that dunnages 40 are placed in an appropriate position within box 22 for maintain in items 32 in the preselected arrangement. Abutting members or elements 56 are also provided on base 42 in order to facilitate the coupling between support member 44 and base 42 as to be more fully described below. The base member 42 is essentially flat and rigid.

Figure 4:
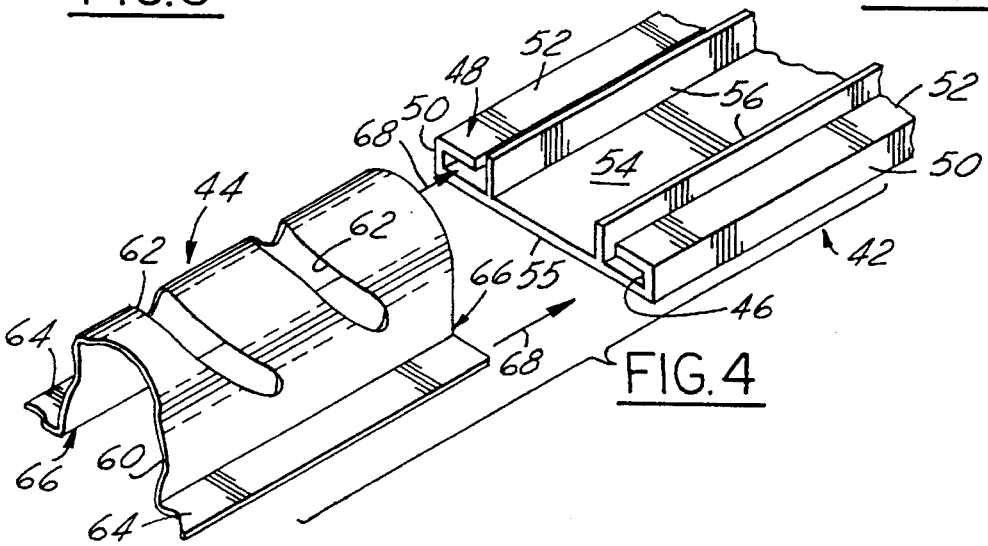
FIG. 4 is a perspective view of the preferred embodiment of the two-piece dunnage illustrating the two pieces in a disassembled orientation.

Support member 44 includes a centrally located raised portion 60, which is illustrated in FIG. 4 as being a curved, parabolic or generally U-shaped portion. The raised portion 60 is essentially flexible or yieldable when subjected to a load. Raised portion 60 may be constructed with or without slits. The raised portion 60 may include one or more transverse slits 62, which are adapted to nestingly receive and support at least a portion of items 32 in order to maintain items 32 in the preselected arrangement within box 22. Flanges 64 are defined on opposite transverse edges of support member 44. Flanges 64 preferably extend transversely outward beginning at transverse ends 66 on raised portion 60. As can be appreciated from the drawings, support member 44 is slidably and preferably removably coupled with base 42. In the embodiment of FIG. 4, for example, flanges 64 are slidably and nestingly received within slots 46 on base 42. Flanges 64 are in an abutting engagement with the upwardly extending portion 50 on flanges 48 of base 42 and the transverse end 66 of raised portion 60 are effectively in abutting engagement with butting members 56 such that support member 44 is prevented from moving transversely while coupled to base member 42.

As will be appreciated by one skilled in the art, a two-piece dunnage designed in accordance with this invention provides the advantage that a variety of support members 44 can be interchangably used with a single base 42. For example, transverse slits in opposing directions can be formed on two support members that are one-half the longitudinal length of a base. The two differing support members can be placed in axial alignment and coupled with the base such that a plurality of items can be disposed within a container and supported by the two-piece dunnage in opposing directions or in another noncontinuous fashion as may be desired. Moreover, the base member of the two-piece dunnage associated with this invention is essentially reusable in an infinite number of applications. The support members can be recycled, reused, or replaced as the needs of a particular situation will dictate. The support member is easily slidingly coupled with and/or removed from the base member. Accordingly, the support members are interchangeable with the base members providing a substantial improvement in economies associated with the use of dunnages.

Figure 3:
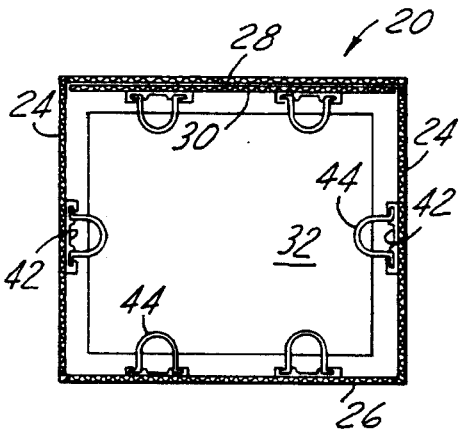
FIG. 3 is a cross-sectional view of the container taken on the line 3—3 of FIG. 2.
Figure 2:
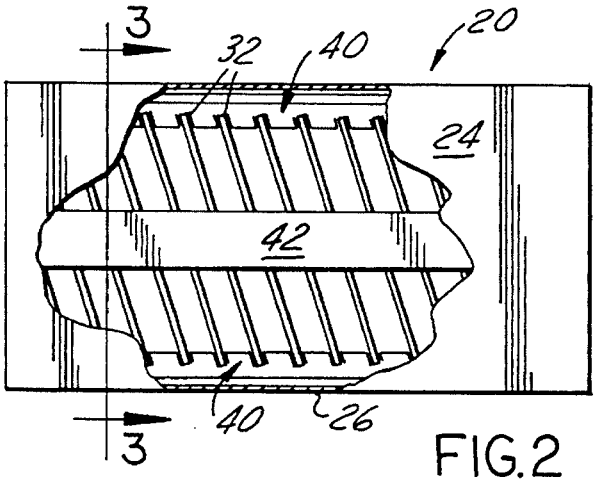
FIG. 2 is a side view, in partial cut-away, of the container shown in FIG. 1.

Referring specifically now to FIGS. 1 through 3, it can be appreciated that the items 32 are nestingly received within a portion of the support member 44 such that items 32 are maintained within box 22 in the preselected arrangement without actually contacting the side, bottom or top walls of the box. In the embodiment illustrated in FIGS. 1–3, the base members 42 are adhesively secured to side wall 24 and top wall 30 of box 22. The bases 42 can also be adhesively secured to bottom wall 26, although, for obvious reasons, that may not be necessary as the situation dictates. It should be understood that the base members 42 may be secured to the side walls 24 and to the top wall by staples, rivets, adhesive or other suitable fastening means such as sonic welding. The embodiment illustrated in FIGS. 1 through 3 demonstrates the advantages provided by a two-piece dunnage formed in accordance with this invention. Dunnages 40 can be placed along the side and top walls of box 22. This provides a substantial advantage in providing additional stability to the preselected arrangement of items 32 within the box 22 compared to the prior art dunnages briefly described above. The prior art dunnages were limited in their ability to provide top and side support as that provided by the dunnage of this invention.

Figure 5:
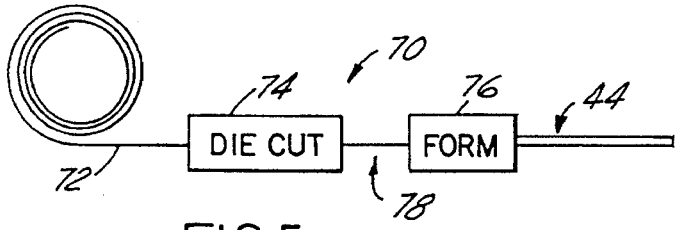
FIG. 5 is a schematic representation of the method of forming a support member which is one member of a two-piece dunnage designed in accordance with this invention.
Figure 6:
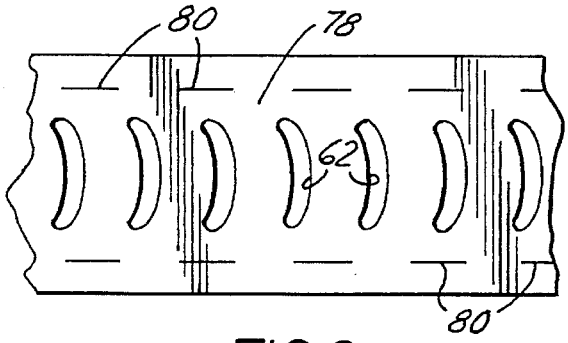
FIG. 6 is a top plan view of a piece of plastic as it would appear during an intermediate step of the method of forming a two-piece dunnage according to this invention.
Figure 7:
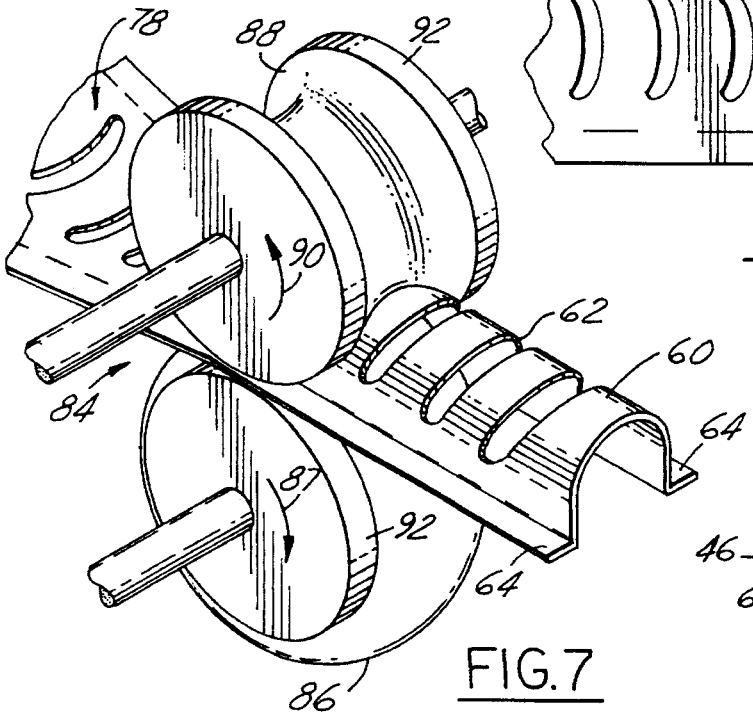
FIG. 7 is a perspective diagrammatic illustration of a portion of the apparatus used with the method associated with this invention in forming the piece of plastic.

Referring now to FIGS. 5 through 7, the method associated with this invention will be described. FIG. 5 schematically illustrates the preferred method of forming the support member 44 of the two-piece dunnage 40 designed in accordance with this invention. The method 70 includes providing a flat sheet or roll 72 of a flexible resilient plastic material and moving that through a die cutting station 74. In die cutting station 74 a series of transverse slits and perforations are made into the flat piece of plastic as will be described more fully below. Then the cut and perforated piece of plastic is moved into a forming station 76 where it is shaped into the useful form of the support member 44.

When the flat flexible piece of plastic is moved through the die cutting station 74 a series of perforations and or scores 80 are placed along two preferably generally parallel lines that run along the longitudinal length of the piece of plastic. Also a series or plurality of transverse cuts or slits 62 are made within the piece of plastic while it is still in a flat state. It is to be understood by one skilled in the art that the perforations and or scores 80 and slits 82 can be made within the piece of plastic 78 in series (either coming first) or simultaneously depending upon the equipment used for the die cutting operation.

The forming station 76 preferably includes a mandrel 84 (as specifically illustrated in FIG. 7) for shaping or forming the flat piece of plastic 78 to result in the support member 44 having a raised portion 60 and flanges 64. Mandrel 84 preferably includes roller member 86 that rotates about its axis according to rotation arrow 87 and the cooperating spool-like member 88 which rotates about its axis according to rotation arrow 90. The flat piece of plastic 78 is preferably heated and then moved through mandrel 84 as illustrated in FIG. 7. As can be appreciated from the drawing the flat piece of plastic is shaped as it moves through mandrel 84 such that the raised portion 60 has the generally U-shaped configuration as illustrated in FIGS. 1 through 4 and 7 and the transverse flanges 64 are extending outwardly from the transverse ends of the raised portion 60. As can also be appreciated from the drawing the flat portions 92 on the spool-like member 88 and the roller member 86 are preferably positioned along the lines defined between the transverse ends of the flat piece of plastic 78 and the perforations and or scores 80 such that the piece of plastic is essentially creased along the perforations and or scores in order to form the flanges 64. Flanges 64 are preferably disposed in a plane generally perpendicular to the transverse ends 66 on raised portion 60. Flanges 64 are preferably defined in a single plane such that the coupling between the base member and the support member are easily facilitated and provide further stability and support for the items 32 within the package during shipment or storage. As an enhancement to the method Just described, when the piece of plastic 78 is passed through mandrel 84 it can be cooled upon exiting in order to maintain the desired shape of the support member 44

Figure 8:
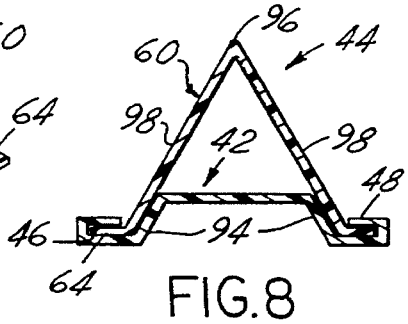
FIG. 8 is a cross-sectional view of a second embodiment of a two-piece dunnage designed in accordance with this invention.

FIG. 8 illustrates a second preferred embodiment of the dunnage designed in accordance with this invention. The variation between the embodiments of FIGS. 8 and 4 can be seen in that the base 42 of the embodiment of FIG. 8 has a base raised abutting portion or abutting elements 94. The raised abutting portion 94 of FIG. 8 is slanted in order to properly cooperate with the support member 44. Support member 44 is generally V-shaped having a peak 96 and a pair of inclined sides 98. Support member 44 also has flanges 64 defined at the ends of the side walls 98 which are distal from the peak 96. As will be appreciated by one skilled in the art, the method described in relation to FIGS. 5–7 will be slightly modified in order to form the support member 44 of FIG. 8. For example, a third line of perforations and or scores is preferably provided along the center line in the longitudinal direction of a single piece of plastic 78 and a crease is formed within the piece of plastic in order to form the peak 96 of the V-shaped or triangular shaped raised portion 60.

Figure 9:
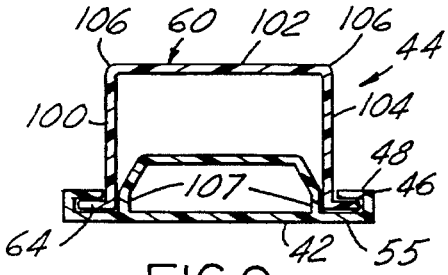
FIG. 9 is a cross-sectional view of a third embodiment of a two-piece dunnage designed in accordance with this invention.

FIG. 9 illustrates another preferred embodiment of the dunnage designed in accordance with this invention. The raised portion 60 of support member 44 is rectangular in cross section. The generally rectangular raised portion 60 is comprised of a first upwardly extending wall 100, a second transversely extending wall 102 and a third downwardly extending wall 104. The corners 106 between the second and first and third walls, respectively, are preferably formed by creasing the piece of plastic during the forming process 76 of the method associated with this invention. Alternatively, third and fourth lines of perforations and or scores can be provided along the piece of plastic during the die cutting operation 74 and an appropriately shaped mandrel provides the creases along the plastic 78 in order to form the raised portion 60 as illustrated in cross section in FIG. 9. Base 42 is modified in FIG. 9 compared to that of FIGS. 4 or 8, for example. Base member 42 of FIG. 9 has abutting portions or abutting elements 107 that are part of an essentially hollow geometric sleeve defined along the longitudinal length, or at least a portion thereof, of the base member 42. One skilled in the art will appreciate that the base member 42 can be modified from those illustrated in FIGS. 4, 8 and 9 in order to provide varying amounts of support, lightweight characteristics, and stability as a particular application will require.

Figure 10:
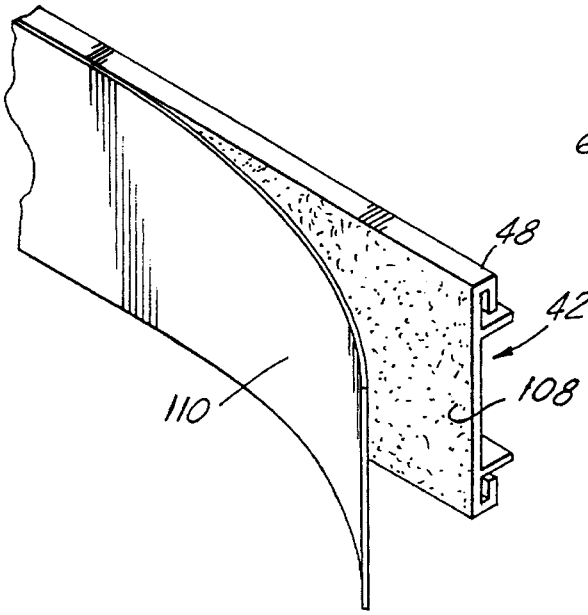
FIG. 10 is a perspective view of a base member with a removable strip for covering the adhesive backing provided on the rear face of the base member.

FIG. 10 illustrates a base 42 which includes an adhesive 108 disposed upon the bottom face 55 for gluing or adhesively securing the base 42 (and accordingly dunnage 40) to any one of the walls within a box, container or other carrying device such as a pallet, rack or other transport device. A removable, protective tab or cover 110 is preferably provided over the adhesive 108 to enable a user to selectively apply base 42 to the wall of the container at the appropriate time. Protective tab 110 is preferably made of a wax paper substance. It will be especially advantageous to secure or glue base 42 to the interior of a box or container that has foldable or collapsible walls such that different support members 44 can be slidably coupled with or removed from the base 42 in order to interchange the support members being used.

From the foregoing it should be appreciated that the support member 44 may be made with or without slots or slits 62. Thus, the dunnages 40 when used without slits may serve as cushioning or spacing members between adjacent items or parts. The raised or curved support members 44 may be provided with various slits, slots, cut outs, notches or other formations. The dunnages 40 may be used with various types of carrying devices or containers including returnable or expendable containers, storage racks, shipping racks, totes, pallets and bins, to name a few.

The preceding description is exemplary rather than limiting in nature. Variations and modification will become apparent to those skilled in the art that do not depart from the purview and spirit of this invention. The scope of this invention is to be limited only by the appended claims.

What is claimed is:

1. A dunnage for use within a container for cushioning or spacing an item within the container during shipping or storage, comprising:

a first elongated base member made from a plastic material and which is essentially flat and rigid and of generally rectangular configuration when viewed from the top, said first elongated base member having a top surface, a bottom surface and a pair of longitudinal edges;

said first elongated base member having a pair of ends and at said longitudinal edges upwardly extending sidewalls which are parallel to one another, said sidewalls at their upper edges having inwardly tuned longitudinally extending top walls which are parallel to and are spaced from said top surface to define a pair of longitudinally extending parallel slots which extend from one end of said first elongated base member to the other end thereof; and a second elongated support member having a pair of ends, a pair of longitudinal edges and being made from a plastic material, said second elongated support member being flexible and having a centrally located raised portion extending from one end thereof to the other end and having at the longitudinal edges thereof a pair of elongated outwardly turned longitudinally extending flanges;

said second elongated support member being slidably and removably coupled to said first elongated base member by inserting one end of said second elongated support member into one end of said first elongated base member and sliding said second elongated base member towards the other end of said first elongated base member where said flanges extend into and lengthwise of said slots to form said dunnage for use within a container;

said longitudinally extending flanges of the second elongated support member being in abutting engagement with the sidewalls of said first elongated base member;

said top surface of said first elongated base member being provided with a pair of upstanding abutting elements which are spaced inwardly from said slots and extend from one end of said first elongated base member to the other end thereof to provide lateral support for said raised portion of the second elongated support member.

2. The dunnage defined in claim 7, wherein said slits are of curved configuration when viewed from the top.

3. The dunnage defined in claim 1, wherein said bottom surface of said bottom elongated base member is provided with an adhesive extending from one end of the first elongated base member to the other end thereof and a removable protective cover overlying said adhesive and extending from one end of the first elongated base member to the other end thereof.

4. The dunnage defined in claim 1, wherein said centrally located raised portion of said second elongated support member is of curved cross section throughout its length.

5. The dunnage defined in claim 1, wherein said centrally located raised portion of said second elongated support member is of triangular cross section throughout its length.

6. The dunnage defined in claim 1, wherein said centrally located raised portion of said second elongated support member is of U-shaped cross section throughout its length, said raised portion having a pair of parallel side walls and a top wall perpendicular to said side walls.

7. The dunnage defined in claim 1, wherein said raised portion has a plurality of transversely extending longitudinally spaced slits provided therein and which extend from one end of said raised portion to the other end thereof, said slits designed to nestingly receive items within a container.

* * * * *